US005088778A

United States Patent [19]

Lin

[11] Patent Number: 5,088,778

[45] Date of Patent: Feb. 18, 1992

[54] HANDLE LOCK WITH IMPROVED ENGAGEMENT AND LINKING-UP

[76] Inventor: Jui C. Lin, No. 55-10, Been Chou Rd., KangShan, Kaohsiung Hsien, Taiwan

[21] Appl. No.: 682,311

[22] Filed: Apr. 9, 1991

[51] Int. Cl.[5] ..... E05B 63/14

[52] U.S. Cl. ..... 292/336.3

[58] Field of Search ..... 292/336.3, 172, 142, 292/173, 143

[56] References Cited

U.S. PATENT DOCUMENTS 4,052,092 10/1977 Bergen ..... 292/172

4,934,800 6/1990 Choi ..... 292/172

4,979,767 12/1990 Lin ..... 292/336.3

*Primary Examiner*—Richard E. Moore

*Attorney, Agent, or Firm*—Fleit, Jacobson, Cohn, Price, Holman & Stern

[57] ABSTRACT

A king of handle lock with improved engagement and linking-up comprises a base with a handle. The base contains a base plate, driving members, a face plate, an inside knob, and a press handle. By the inner moving tube engaged with the driving plate of latch, the inside knob and outside knob will alone drive the inner moving tube.

5 Claims, 7 Drawing Sheets

HANDLE LOCK WITH IMPROVED ENGAGEMENT AND LINKING-UP

BACKGROUND OF THE INVENTION

This invention relates to a handle lock with improved engagement and linking-up. The conventional handle lock comprises a press handle 112 at the outside of the door as shown in FIG. 1. When the press handle is pressed, the transmitting plate 23 driven by the teeth 222 of driving plate 22 rotates to retract the dead bolt. Similarly, the transmitting plate 23 driven by an inside knob rotates to retract the dead bolt. In this kind of handle lock, the square tube 24 of latch is driven by turning the inside knob or outside knob so that turning the inside knob will drive the outside knob, and vice versa. Moreover, the coil spring will be pressed by turning inside or outside knobs so that the increased forces of press and rotation will cause to reduce the life of handle lock with higher fault rate.

SUMMARY OF THE INVENTION

This invention is to provide a handle lock with improved engagement and linking-up. The outside knob or inside knob will alone pull the latch, and the other knob will not work simultaneously so that the reduced forces of press and rotation will cause to increase the life of handle lock with lower fault rate.

The handle lock comprises a base plate, an inside knob, driving members, a face plate, and a press handle. By the inner moving tube engaged with the driving plate of latch, the inside knob and outside knob will alone drive to rotate the inner moving tube.

BRIEF DESCRIPTION OF THE DRAWINGS

This invention will now be described in detail with reference to the accompanying drawings wherein.

DETAILED DESCRIPTION OF THE INVENTION

Figure 1:
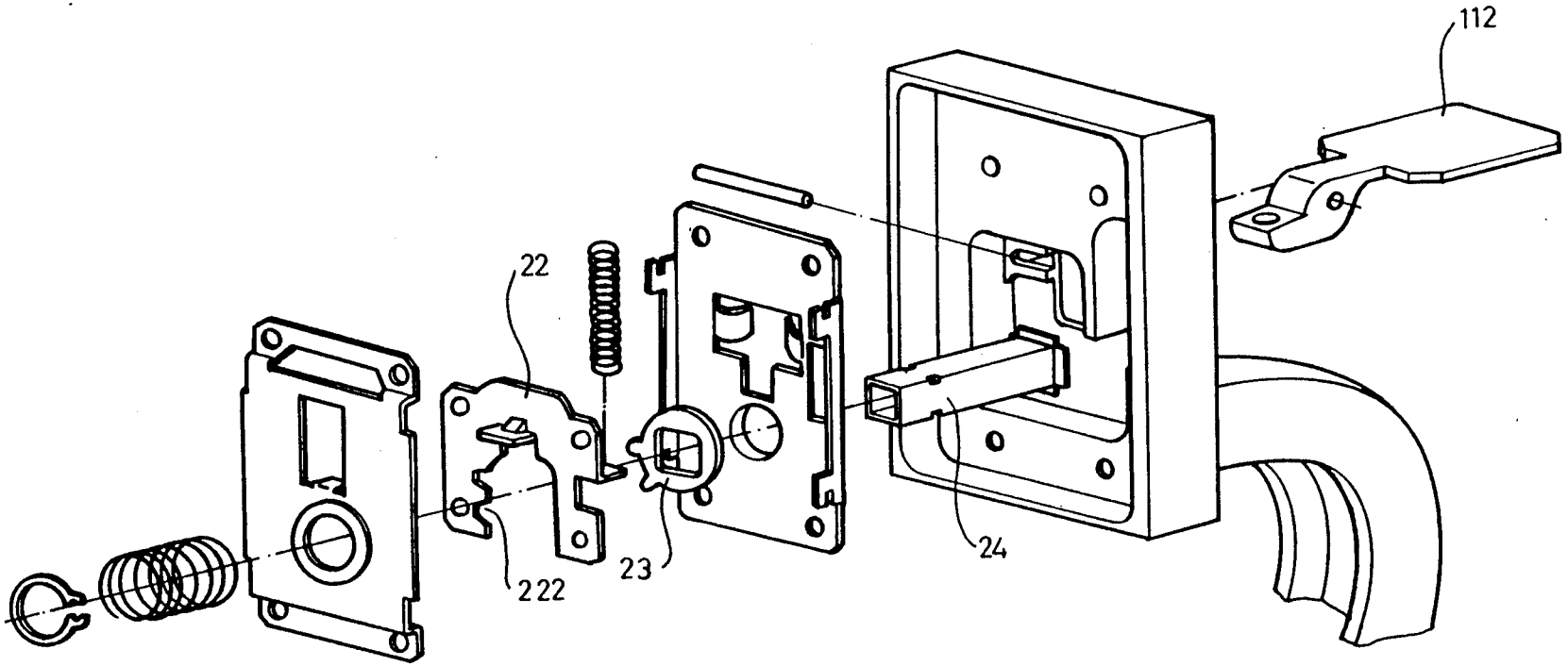
FIG. 1 (PRIOR ART)
FIG. 1 is a solid exploded perspective view of the conventional handle lock.
Figure 2:
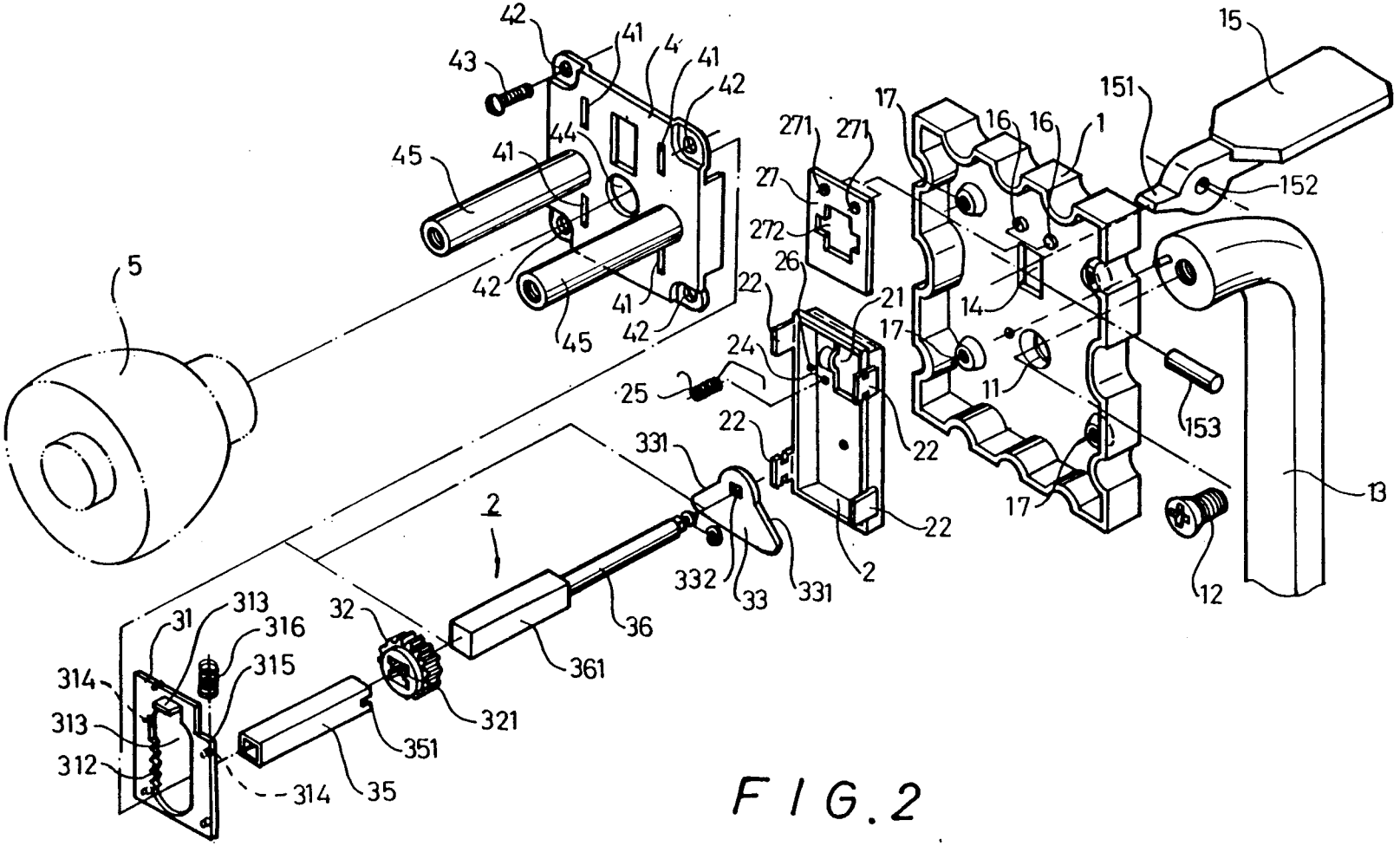
FIG. 2 is a solid exploded perspective view of the first example in this invention.

First, referring to FIG. 2, this is the first example of this invention. The handle lock comprises a base 1, a base plate 2, driving members 3, a face plate 4, and an inside knob 5. The base 1 is to combine with each constituting member. The screw 12 inserts into the hole 11 of base 1 to combine base 1 and a handle 13. A square hole 14 above the hole 11 is to provide the neck 151 of press handle 15 to insert from the outside of base 1. A pin 153 which is fixed at the half shaft hole 21 of base plate 2 inserts into the shaft hole 152 of neck 151 so that the press handle 15 pivots upon pin 153. Pin 153 at the half shaft hole 21 is covered by a plate 27 which has two holes 271 to set two posts 16 of base 1. Hence, the plate 27 is adhered tightly between base plate 2 and base 1. Base plate 2 has four protruded feet 22 to stick in the holes 41 of face plate 4. Two protruded feet are higher than the other two so that two higher feet will be folded to combine base plate 2 with face plate 4. The screws 43 pass through four holes 42 of face plate 4 to fix at the screw holes 17 of base 1.

The base plate 2 using four feet 22 to engage with the holes 41 of face plate 4 is a concave box. The base plate 2 has a half shaft hole 21 which unites with plate 27 to confine a pin 153. The base plate 2 and plate 27 after matching are adhered at the inner wall of base 1. The base plate 2 is to contain a gear plate 31, a gear 32, and a sector plate 33. The base plate 2 has a post 24 to set a coil spring 25 whose one end is set in the hole 26 of base plate 2, and another end presses at the neck 151 of press handle 15. The press handle 15 will be restored after being pressed.

Driving members 3 comprise a gear plate 31, a gear 32, a sector plate 33, an inner moving tube 35, and a turning shaft 36.

Gear plate 31 has an oval slot 311 whose longer side has teeth 312 to engage with a gear 32 for linking-up. Gear plate 31 has a protruded key block 313 above the oval slot 311. The key block 313 contacts the end of press handle 15 so that gear plate 31 will move up when press handle is pressed. Gear plate 31 has two protruded posts 314. The posts 314 will press two shoulders 331 of sector plate 33 when gear plate 31 is fixed at the base plate 2. The sector plate 33 couples with gear plate 31 by shoulders 331 pressing the posts 314 of gear plate 31. Gear plate 31 has a concave shoulder 315 to lay a coil spring 316 which retracts gear plate 31 after gear plate 31 moving up. Gear plate 31 has protrusions 317 which are higher than posts 314 so that protrusions 317 contact base plate 2 for moving gear plate 31 smoothly and easily.

Gear 32 is engaged with the teeth 312 of gear plate 31. Gear 32 has a lip 322 to engage with the hole 44 of face plate 4 so that gear 32 can rotate firmly. Gear 32 has a key 321 to set in the key slot 351 of inner moving tube 35 which passes through the driving plate of latch so that the dead bolt can be pulled by turning the inner moving tube 35.

Sector plate 33 has a square hole 332 engaged with the square end 362 of turning shaft 36. Sector plate 33 has two shoulders 331 which prop respective posts 314 of gear plate 31 so that turning sector plate 33 can move gear plate 31 up by shoulders 312 propping posts 314. Also gear plate 31 can be restored by posts 314 pressing sector plate 33 down.

Turning shaft 36 has a round shaft to pass through inner moving tube 35 and rotate therein. The square end 362 which is retained by an C-ring 363 is engaged with the square hole 332 of sector plate 33. The turning shaft 36 has a square shaft 361 which is engaged with the inside knob 5 for rotating.

Face plate 4 has four holes 41 to set base plate 2. Face plate 4 is fixed at base 1 by screws 43 screwing the holes 42 of face plate 4. Face plate 4 has a hole 44 for inner moving tube 35 passing through and gear 32 rotating therein. Face plate 4 has two screw posts 45 which pass through the limit holes of latch for screws to fix at the door.

Figure 4:
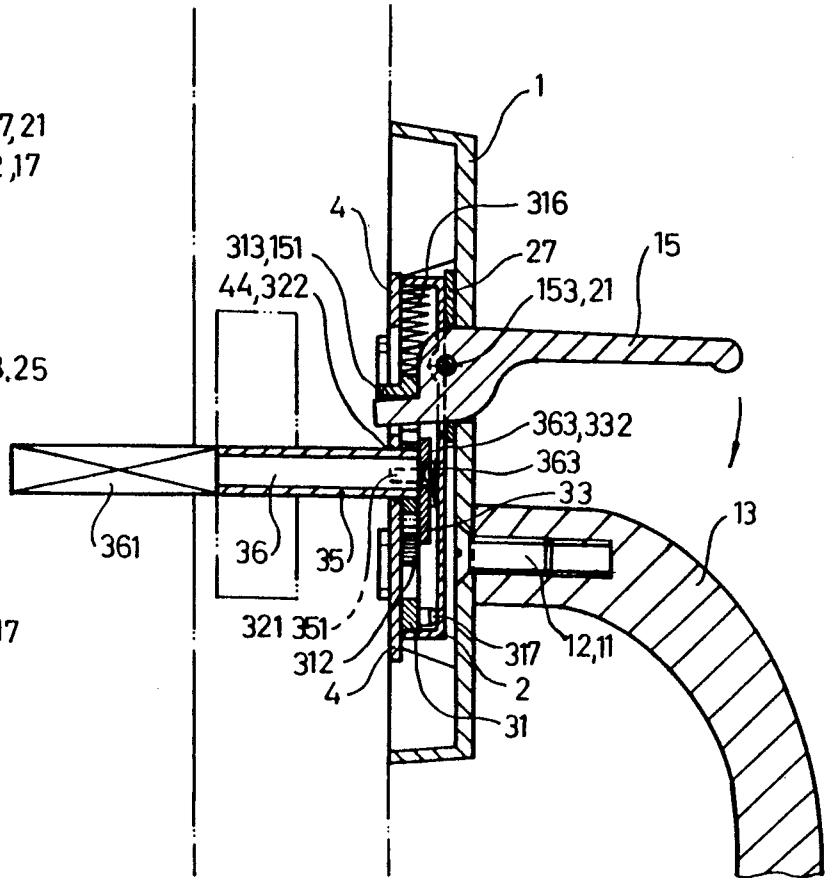
FIG. 4 is a cross-sectional view taken along line 4—4 of FIG. 3.
Figure 3:
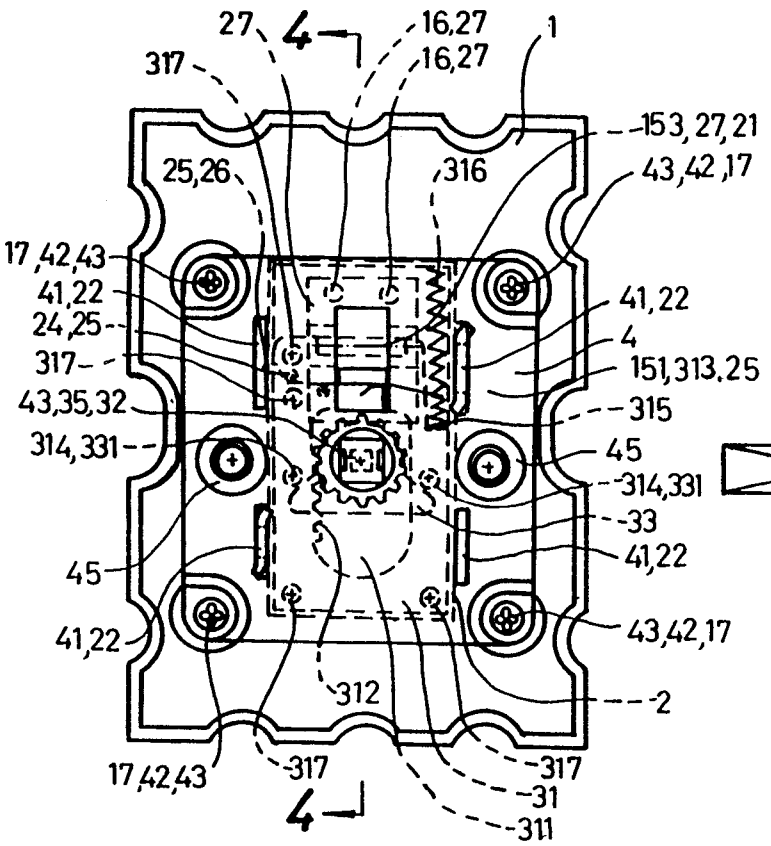
FIG. 3 is a back view of the first example.

Referring to FIGS. 3 and 4, after assembling these members, the latch is set inside the inner moving tube 35. When press handle 15 is not pressed, gear plate 31 is lowered to the bottom of base plate 2 by the extension of coil spring 316. Gear 32 is engaged with the teeth 312 of gear plate 31 so that two shoulders 331 of sector plate 33 contact with respective posts 314 of gear plate 31.

Figure 5:
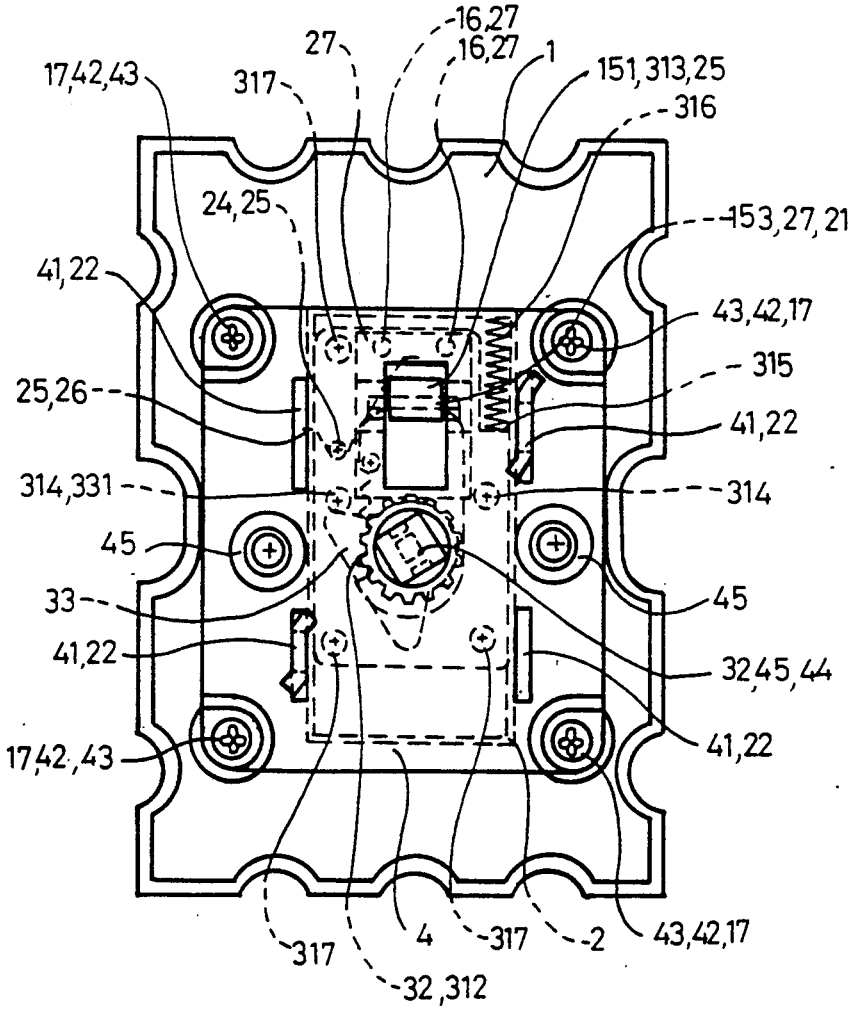
FIG. 5 is an actional view of the first example in this invention.

When the assembled handle lock is opened from the outside of the door as shown in FIG. 3, press handle 15 pivots upon a pin 153 so that the end of press handle 15 pushes the key block 313 of gear plate 31 which drives gear 32 to rotate as shown in FIG. 5. The inner moving tube 35 driven by gear 32 pulls the dead bolt inward. When gear plate 31 moves up, the posts 314 of gear plate 31 and the shoulders 331 of sector plate 33 are separated so that sector plate 33 and turning shaft 36 will not rotate with the inside knob 5. When the force applied to press handle 15 is released, press handle 15 will be restored by the extension of coil spring 25. Also gear plate 31 will be restored by the extension of coil spring 316 until the posts 314 of gear plate 31 contact the shoulders 331 of sector plate 33. The latch also has a coil spring to turn the inner moving tube.

When the handle lock is opened by turning inside knob 5, the inside knob 5 will drive turning shaft 36 to rotate inside the inner moving tube 35. The square end of turning shaft 33 drives sector plate 33 so that one shoulder 331 will press the post 314 of gear plate 31 and pull gear plate 31 up when sector plate 33 turns right or left. Gear 32 rotated by moving teeth 312 drives the inner moving tube 35 to pull the dead bolt inward for opening the door. When gear plate 31 moves up, the key block 313 of gear plate 31 and the end of press handle 15 separate gradually so that press handle 15 does not work in this situation. The recoil check spring of inside knob 5 will restore inside knob 5 when the force turning inside knob 5 disappears. At the same time, turning shaft 36 and sector plate 33 will be restored by inside knob 5. Gear plate 31 is restored by the extension of coil spring 316 so that inner moving tube will be restored by rotating gear 32.

Figure 6:
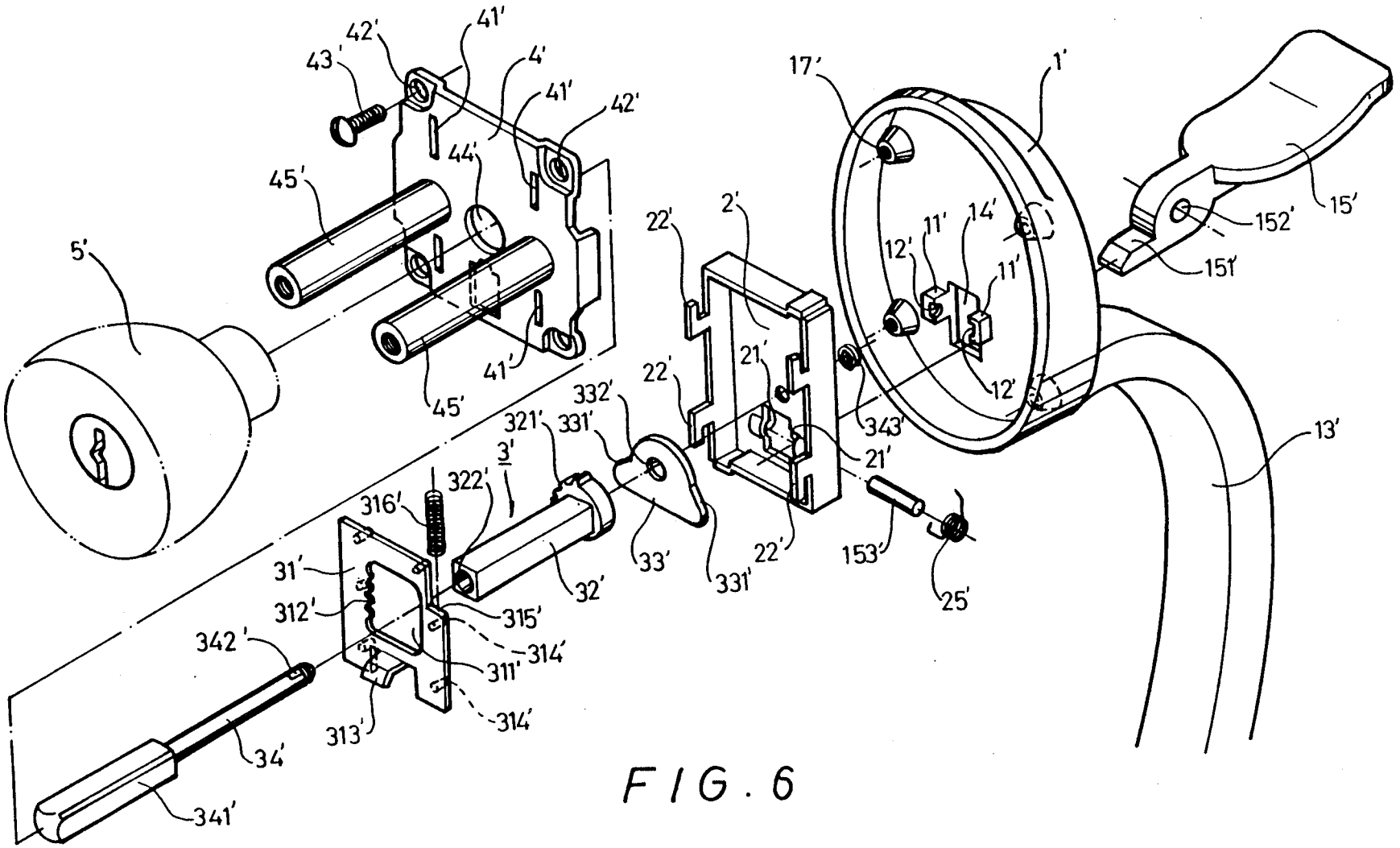
FIG. 6 is a solid exploded perspective view of the second example in this invention.

Referring to FIG. 6, this is the second example of this invention. The handle lock comprises a base 1', a base plate 2', driving members 3', a face plate 4', and an inside knob 5', etc.. Base 1' is to combine with each constituting member. The base 1' has a mono-block handle 13' which has a square hole 14' to insert the neck 151' of press handle 15' from the outside of base 1'. The neck 151' has a shaft hole 152' to insert a pin 153'. The one side of square hole 14' has two lugs 11 which has a half shaft hole 12' to lay a pin 153' which is also engaged with the half shaft hole 21' of base plate 2' so that press handle 15' can pivot upon pin 153' for pressing action.

Base plate 2' has four protruded feet 22'. Two feet are higher than the other two so that the feet 22' will insert into the holes 41' of face plate 4' and two higher feet are folded to combine base plate 2' with face plate 4' as shown in FIG. 2. The bolts 43' passes through four holes 42' of face plate 4' to fix at the screw holes 17' of base 1'.

The base plate 2' using four feet 22' to engage with the holes 41' of face plate 4' is a concave box. Base plate 2' has a half shaft hole 21' which unites with the half shaft hole 12' of base 1' to confine a pin 153'. The base plate 2' is contain a gear plate 31', a moving tube 32', a sector plate 33', and a coil spring 25'. Coil spring 25' whose one end props the inside of base 1' and another end presses the neck 151' of press handle 15' so that press handle 15' will be restored after being pressed.

Driving members 3' comprise a gear plate 31', a moving tube 32', a sector plate 33', and a turning shaft 34'.

Gear plate 31' has a slot 311' whose one side has teeth 312' to engage with the teeth 321' of moving tube 32' for linking-up. The slot 311' of gear plate 31' has a protruded key block 313' at its bottom. The key block 313' contacts the end of press handle 15' so that gear plate 31' can be pulled to move up when press handle 15' is pressed. The gear plate 31' has six posts 314' which stretch into base plate 2' when gear plate 31' is combined with base plate 2'. The posts 314' prop the inside of base plate 2' with point contact for gear plate 31' moving easily. Two central posts 314' press two shoulders 331' of sector plate 33' to turn sector plate 33'. Also two shoulders 331' can press the posts 314' of gear plate 31' for coupling gear plate 31'. Gear plate 31' has a concave shoulder 315' to lay a coil spring 316' which restores gear plate 31' after gear plate 31 moving up.

Moving tube 32' which has teeth 321' to engage with the teeth 312' of gear plate 31' is a square tube. The moving tube 32' passes through the driving plate of latch so that the dead bolt can be pulled by turning the moving tube 32'. Moving tube has a round inner hole 322' which is to provide the round shaft of turning shaft 34' passing through and rotating therein.

Sector plate 33' has an oval shaft hole 332' which is engaged with the oval end 342' of turning shaft 34'. Sector plate 33' has two shoulders 331' which prop two respective central posts 314' of gear plate 31' so that turning sector plate 33' can move gear plate 31' up by shoulders 312' propping posts 314'. Also gear plate 31' can be restored by posts 314' pressing sector plate 33' down.

Turning shaft 34' has a round shaft to pass through the round inner hole 322' of moving tube 32' and rotate therein. The oval end 342' which is retained by an C-ring 343' is engaged with the oval shaft hole 332' of sector plate 33'. The turning shaft 34' has a square shaft 341' which is engaged with the inside knob 5' for rotating.

Face plate 4' has four holes 41' to set base plate 2'. Face plate 4' is fixed at base 1' by screws 43' screwing the holes 42' of face plate 4'. Face plate 4' has a hole 44' for moving tube 32' passing through. Face plate 4' has two screw posts 45' which pass through the limit holes of latch for screws to fix at the door.

Figure 8:
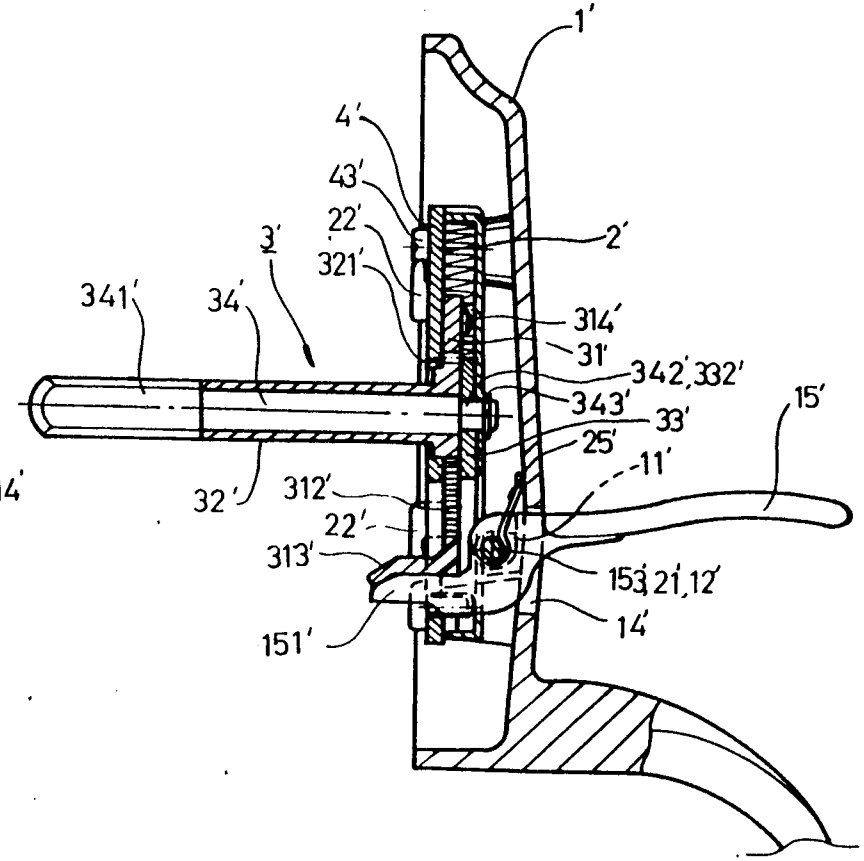
FIG. 8 is a cross-sectional view taken along line 8—8 of FIG. 7.
Figure 7:
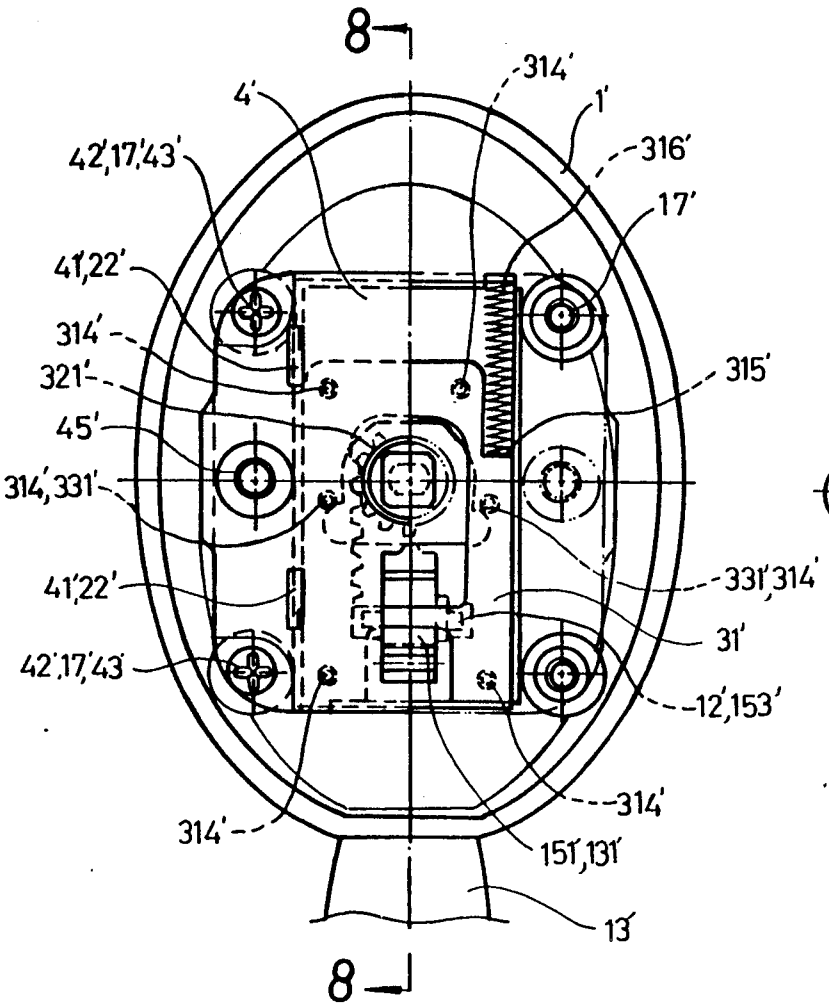
FIG. 7 is a back view of the second example after assembled.

Referring to FIGS. 7,8, after assembling these members, the latch is set inside the moving tube 32'. When press handle 15' is not pressed, gear plate 31' is lowered to the bottom of base plate 2' by the extension of coil spring 316'. Teeth 321' are still engaged with the teeth 312' of gear plate 31' so that two shoulders 331' of sector plate 33' contact with respective posts 314' of gear plate 31'.

Figure 10:
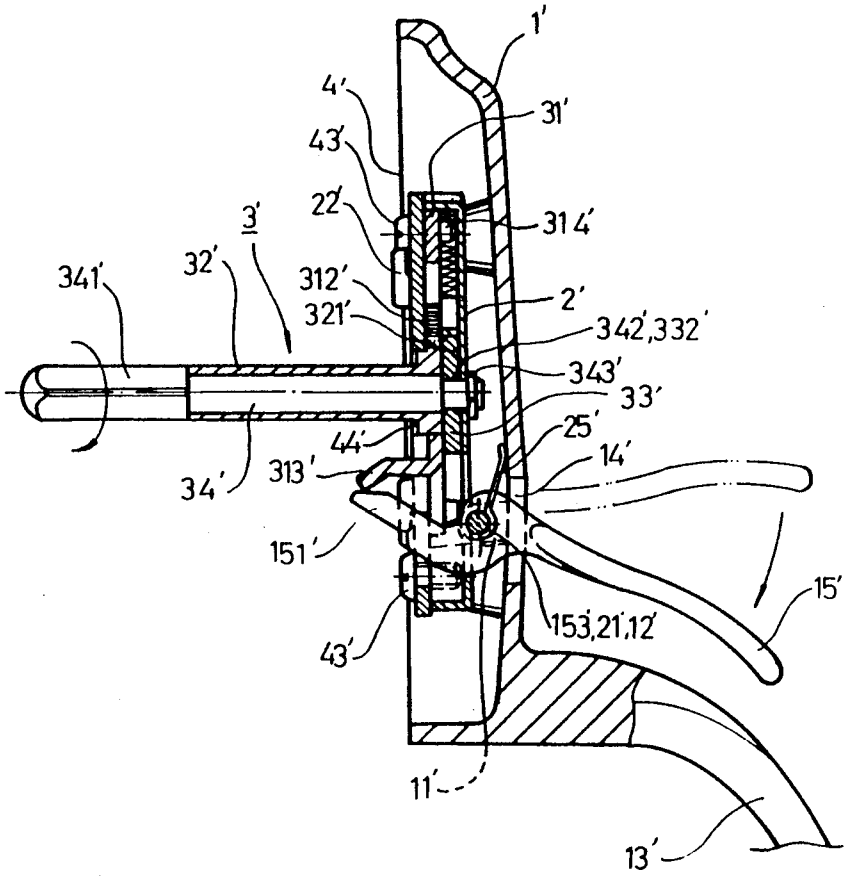
FIG. 10 is a cross-sectional view taken along line 10—10 of FIG. 9.
Figure 9:
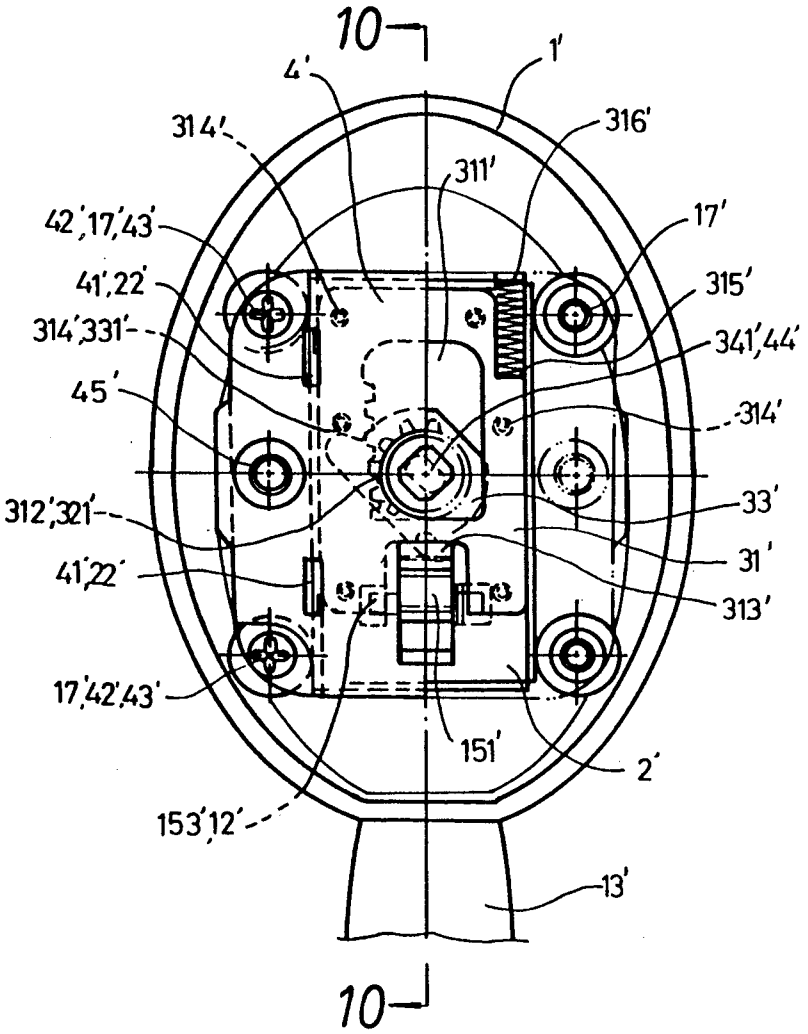
FIG. 9 is an actional view of FIG. 7.

When the assembled handle lock is opened from the outside of the door as shown in FIGS. 9 and 10, press handle 15' pivots upon a pin 153' so that the end of press handle 15' pushes the key block 313' of gear plate 31' which drives teeth 321' to rotate as shown in FIG. 9. The moving tube 32' driven by teeth 321 pulls the dead bolt inward. When gear plate 31 moves up, the posts 314 of gear plate 31, and the shoulders of sector plate 33, are separated so that sector plate 33 and turning shaft 34' will not rotate with the inside knob 5'. When the press force applied to press handle 15' is released, press handle 15' will be restored by the extension of coil spring 25'. Also gear plate 31' will be restored by the extension of coil spring 316' until the posts 314' of gear plate 31' contact the shoulders 331' of sector plate 33'. The latch also has a coil spring to turn the inner moving tube.

When the handle lock is opened by turning inside knob 5', the inside knob 5' will drive turning shaft 34' to rotate inside the moving tube 32'. The oval end of turning shaft 34' drives sector plate 33' so that one shoulder 331' will press the post 314' of gear plate 31' and pull gear plate 31' up when sector plate 33' turns right or left. Teeth 321' rotated by moving teeth 312' drives moving tube 32' to pull the dead bolt inward for opening the door. When gear plate 31' moves up, the key block 313' of gear plate 31' and the end of press handle 15' separate gradually so that press handle 15' does not work in this situation. The recoil check spring of inside knob 5' will restore the inside knob 5' when the force turning inside knob 5 disappears. At the same time, turning shaft 34' and sector plate 33' will be restored by inside knob 5'. Gear plate 31' is restored by the extension of coil spring 316' so that moving tube 32' will be restored by rotating teeth 321'.

The handle lock in accordance with this invention is that the outside knob or inside knob will alone pull the dead bolt and the other knob will not work simultaneously so that the reduced forces of press and rotation will cause to increase the life of handle lock with lower fault rate. Base 1 and handle 13 can be manufactured in mono-block or piece by piece.

What is claimed is:

1. A lock structure for operating a dead bolt in a door and the like comprising a moving tube adapted to be rotated in order to operate the dead bolt, a rotary knob on one side of the structure, a pivotal pressure plate on an opposite side of the structure and a drive mechanism for rotating the moving tube both by rotation of the knob and by pivotal movement of the pressure plate, the drive mechanism comprising a turning shaft having a first portion received rotatably in the moving tube, a second portion at one end of the first portion non-rotatably coupled to the rotary knob and a third portion at an opposite end of the first portion projecting from the moving tube, a sector plate non-rotatably mounted on the third portion of the turning shaft, a gear plate formed with linear gear teeth and with protrusions engaging opposite sides of the sector plate whereby rotation of the sector plate by the rotary knob through the turning shaft is effective to move the gear plate in a direction lengthwise of the gear teeth, a gear in mesh with said gear teeth and drivingly engaged with said moving tube whereby movement of the gear plate in said direction is effective to rotate the moving tube for operating the deadbolt, the structure further including an abutment on the said gear plate, a plate assembly providing a pivotal support for said pressure plate, and a tongue extending from the pressure plate engaging said abutment for moving the gear plate in said direction independently of the sector plate by pivotal movement of the pressure plate thereby rotating the moving tube for operating the deadbolt by pressure applied to the pressure plate.

2. A structure as claimed in claim 1 including first spring means between the pressure plate and said plate assembly for returning the pressure plate to a rest position after operation of the deadbolt.

3. A structure as claimed in claim 1 including second spring means between the gear plate and said plate assembly for returning the gear plate to ar est position after operation of the deadbolt.

4. A structure as claimed in claim 1 wherein the gear plate has a central opening with the gear teeth formed along one side of said opening, the protrusions engaging the sector plate being located on opposite sides of the central opening and the abutment engaging said tongue being located at one end of the central opening.

5. A structure as claimed in claim 4 wherein the gear plate has further protrusions for engaging one plate of said plate assembly for guiding the gear plate.

* * * * *